United States Patent [19]

Brown

[11] 4,108,353

[45] Aug. 22, 1978

[54] CENTRIFUGAL APPARATUS WITH OPPOSITELY POSITIONED ROTATIONAL SUPPORT MEANS

[75] Inventor: Richard I. Brown, Northbrook, Ill.

[73] Assignee: Baxter Travenol Laboratories, Inc., Deerfield, Ill.

[21] Appl. No.: 829,291

[22] Filed: Aug. 31, 1977

[51] Int. Cl.[2] ..... B04B 9/08

[52] U.S. Cl. ..... 233/26

[58] Field of Search ..... 233/23 R, 24, 25, 26, 233/27, 1 R; 64/2 R; 74/797

[56] References Cited

U.S. PATENT DOCUMENTS

| | | | |
|---|---|---|---|
| 3,586,413 | 6/1971 | Adams | 64/2 R |
| 3,986,442 | 10/1976 | Khoja | 74/797 |

*Primary Examiner*—George H. Krizmanich
*Attorney, Agent, or Firm*—Henry W. Collins; Paul C. Flattery; George H. Gerstman

[57] ABSTRACT

Centrifugal processing apparatus in which a processing chamber is rotatably mounted with respect to a stationary base. An umbilical cable segment is fixed at one end substantially along the axis of the processing chamber at one side thereof, with the other end of the cable segment being attached substantially on the axis in rotationally locked engagement to the processing chamber. Loading and removal of the processing chamber is simplified by providing a turn arm coupled to one side of the processing chamber, around the processing chamber and to a spaced location at the other side of the processing chamber. The turn arm is rotatably coupled to the processing chamber at the one side thereof and the turn arm is also rotatably coupled to the stationary base at the other side of the processing chamber. The interconnections are such that by rotating the turn arm at a first angular velocity about the predetermined axis, the processing chamber will be rotated at twice the first angular velocity about the predetermined axis. The processing chamber and associated cable segment may be attached to the drive mechanism without requiring portions thereof to be passed through a central drive shaft, as required by certain prior art constructions.

19 Claims, 7 Drawing Figures

FIG. 1
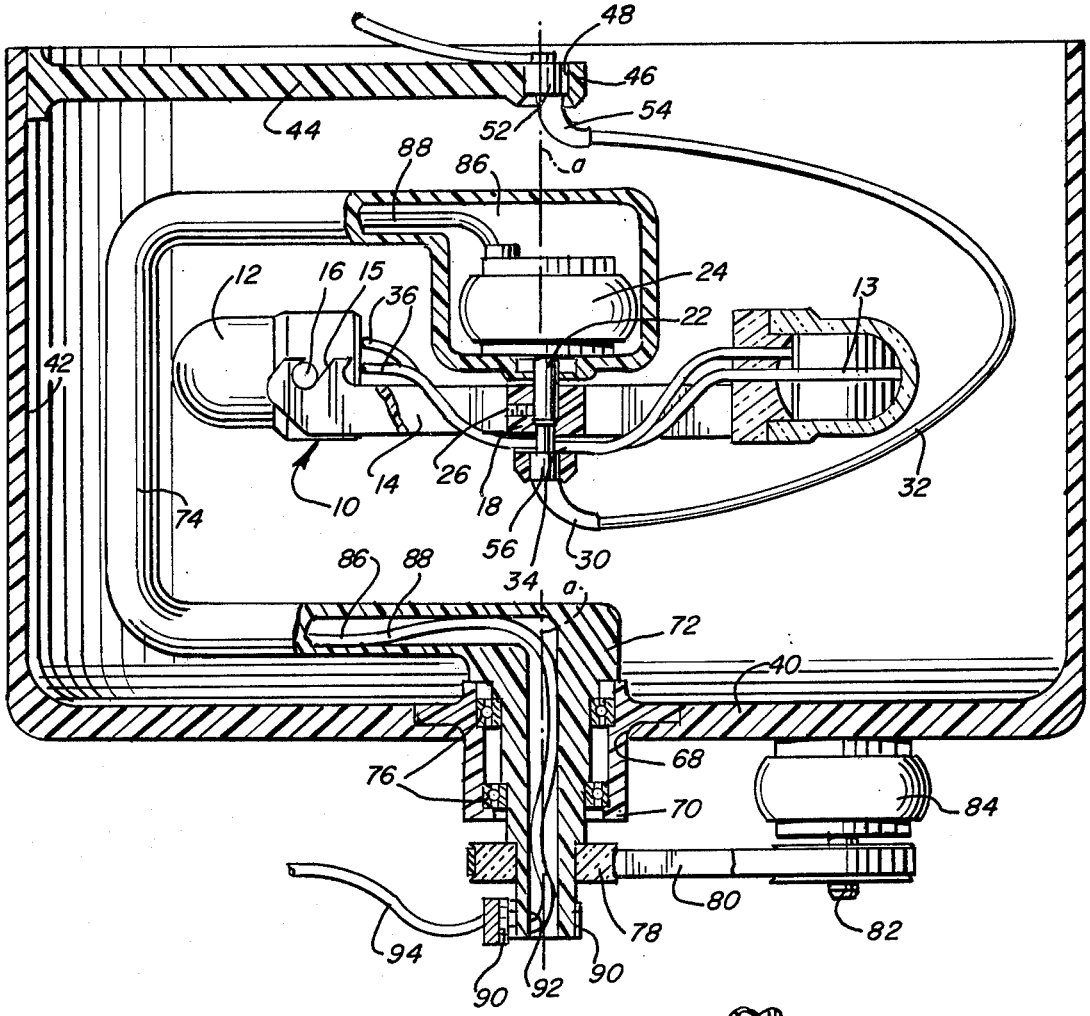
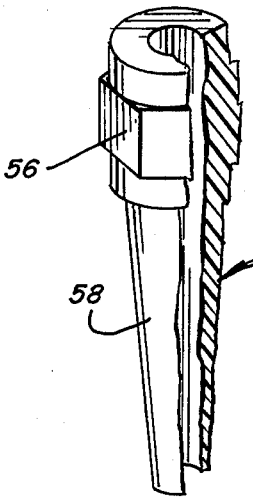
FIG. 2
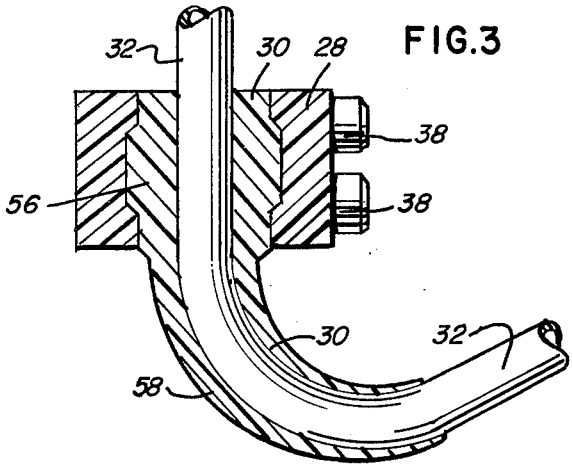
FIG. 3
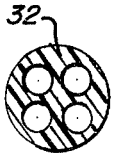
FIG. 4

CENTRIFUGAL APPARATUS WITH OPPOSITELY POSITIONED ROTATIONAL SUPPORT MEANS

BACKGROUND OF THE INVENTION

The present invention concerns centrifugal processing apparatus and, more particularly, apparatus employing umbilical tubing which is rotated with respect to a stationary base.

Centrifugal processing systems are used in many fields. In one important field of use, a liquid having a suspended mass therein is subjected to centrifugal forces to obtain separation of the suspended mass.

As a more specific example, although no limitation is intended herein, in recent years the long term storage of human blood has been accomplished by separating out the plasma component of the blood and freezing the remaining red blood cell component in a liquid medium, such as glycerol. Prior to use, the glycerolized red blood cells are thawed and pumped into the centrifugating wash chamber of a centrifugal liquid processing apparatus. While the red blood cells are being held in place by centrifugation, they are washed with a saline solution which displaces the glycerol preservative. The resulting reconstituted blood is then removed from the wash chamber and packaged for use.

The aforementioned blood conditioning process, like other processes wherein a liquid is caused to flow through a suspended mass under centrifugation, necessitates the transfer of solution into and out of the rotating wash chamber while the chamber is in motion. Thus while glycerolized red blood cell and saline solution are passed into the wash chamber, waste and reconstituted blood solutions are passed from the chamber. To avoid contamination of these solutions, or exposure of persons involved in the processing operation to the solutions, the transfer operations are preferably carried out within a sealed flow system.

One type of centrifugal processing system which is well adapted for the aforementioned blood conditioning process uses the principles of operation described in Dale A. Adams U.S. Pat. No. 3,586,413. The apparatus of the Adams patent establishes fluid communication between a rotating chamber and stationary reservoirs through a flexible interconnecting umbilical cord without the use of rotating seals, which are expensive to manufacture and which add the possibility of contamination of the fluid being processed.

The primary embodiment of the Adams patent comprises a rotating platform which is supported above a stationary surface by means of a rotating support. A tube is connected to the stationary support along the axis of the rotating platform and the rotating support, with the tube extending through the rotating support and having one end fastened to the axis of the rotating platform. A motor drive is provided to drive both the rotating platform and the rotating support in the same relative direction at speeds in the ratio of 2:1, respectively. It has been found that by maintaining this speed ratio, the tube will be prevented from becoming twisted. An improvement with respect to this principle of operation, comprising a novel drive system for a centrifugal liquid processing system, is disclosed in Khoja, et al. U.S. Pat. No. 3,986,442. In the Khoja, et al. patent, a novel drive system is provided for driving a rotor assembly at a first speed and a rotor drive assembly at one-half the first speed, in order to prevent an umbilical tube from becoming twisted.

In certain prior art centrifugal processing apparatus, portions of the systems must pass through a hollow central drive shaft during loading and unloading. In some constructions, the tube must be passed through a drive shaft opening in order to load and unload the system, while in other constructions needles, solution bags, tubing manifold plates or other devices must be passed through a hollowed central drive shaft. To avoid the necessity of passing the tubing or other elements through a hollowed central drive shaft, one of the elements would be initially disconnected and then connected after the system was loaded. For unloading, the element would then be disconnected so as to revert to its initial condition. However, such connection and disconnection is deleterious to sterile conditions.

It is, therefore, an object of the invention to provide means permitting loading or unloading of the system without requiring an operator to pass tubing or other portions of the system through a hollowed central shaft.

A further object of the invention is to provide centrifugal processing apparatus which can be loaded and unloaded without breaking the connections in tubing or other parts.

A still further object of the invention is to provide centrifugal processing apparatus which is simple to load and unload and is easily cleanable.

Another object of the present invention is to provide centrifugal processing apparatus that requires fewer hardware type seals than prior art apparatus yet achieves the advantages concomitant with prior art constructions.

A further object of the present invention is to provide centrifugal processing apparatus which is relatively simplified in construction and efficient to manufacture.

Other objects and advantages of the present invention will become apparent as the description proceeds.

BRIEF DESCRIPTION OF THE INVENTION

In accordance with the present invention, centrifugal processing apparatus is provided which comprises a stationary base and a processing chamber rotatably mounted with respect to the base for rotation about a predetermined axis. A flexible umbilical cable segment is provided for establishing communication with the processing chamber. One end of the cable segment is fixed with respect to the base substantially along the axis at one side of the processing chamber. The cable segment extends around the processing chamber with the other end of the cable segment attached substantially on the axis in rotationally locked engagement to the processing chamber.

A one $\omega$ turn arm is coupled to the one side of the processing chamber, around the processing chamber and to a spaced location at the other side of the processing chamber. First rotatable support means couple the one $\omega$ turn arm to the processing chamber at one side thereof and second rotatable support means couple the one $\omega$ turn arm to the stationary base at the other side of the processing chamber. Means are provided for rotating the turn arm at one $\omega$ about the predetermined axis.

As used herein, the term "one $\omega$" signifies any rotational velocity and is used as a relative term so that the term "two $\omega$" is used to designate an angular velocity twice the angular velocity of one $\omega$.

In one embodiment, the rotating means comprises an electric motor connected to the turn arm for rotating the turn arm about the predetermined axis at one $\omega$. Another electric motor having a shaft that is fastened to the turn arm at the one side of the processing chamber, with the shaft extending from the turn arm substantially on the predetermined axis and with the shaft being fixed to the processing chamber and rotatable with respect to the turn arm. This shaft rotates at one ω and cooperates with the one ω rotation of the turn arm about the predetermined axis to cause two ω rotation of the processing chamber.

In one embodiment, a flexible shaft is carried by the turn arm. One point of the flexible shaft is fixed to the stationary base substantially on the predetermined axis and another point of the flexible shaft is fixed to the processing chamber substantially on the predetermined axis. One ω rotation of the turn arm about the predetermined axis causes one ω rotation of the flexible shaft about its own axis. The cooperative one ω rotation of the turn arm about the predetermined axis and one ω rotation of the flexible shaft about its own axis results in two ω rotation of the processing chamber.

In one embodiment, the one ω rotation of the turn arm about the predetermined axis coupled with the one ω rotation of the cable segment about the predetermined axis results in two ω rotation of the processing chamber about the predetermined axis.

A more detailed explanation of the invention is provided in the following description and claims, and is illustrated in the accompanying drawings.

BRIEF DESCRIPTION OF THE DRAWINGS

FIG. 1 is an elevational view, taken partially in cross-section for clarity, of centrifugal processing apparatus constructed in accordance with one embodiment of the present invention;

FIG. 2 is an elevational view, partially broken for clarity, of a flexible sheath used in connection with the centrifugal processing apparatus of the present invention;

FIG. 3 is a view, taken partially in cross-section, of a two ω flexible sheath holder constructed in accordance with the principles of the present invention;

FIG. 4 is a cross-sectional view of a cable segment constructed in accordance with the principles of the present invention;

DETAILED DESCRIPTION OF THE ILLUSTRATIVE EMBODIMENTS

Figure 5:
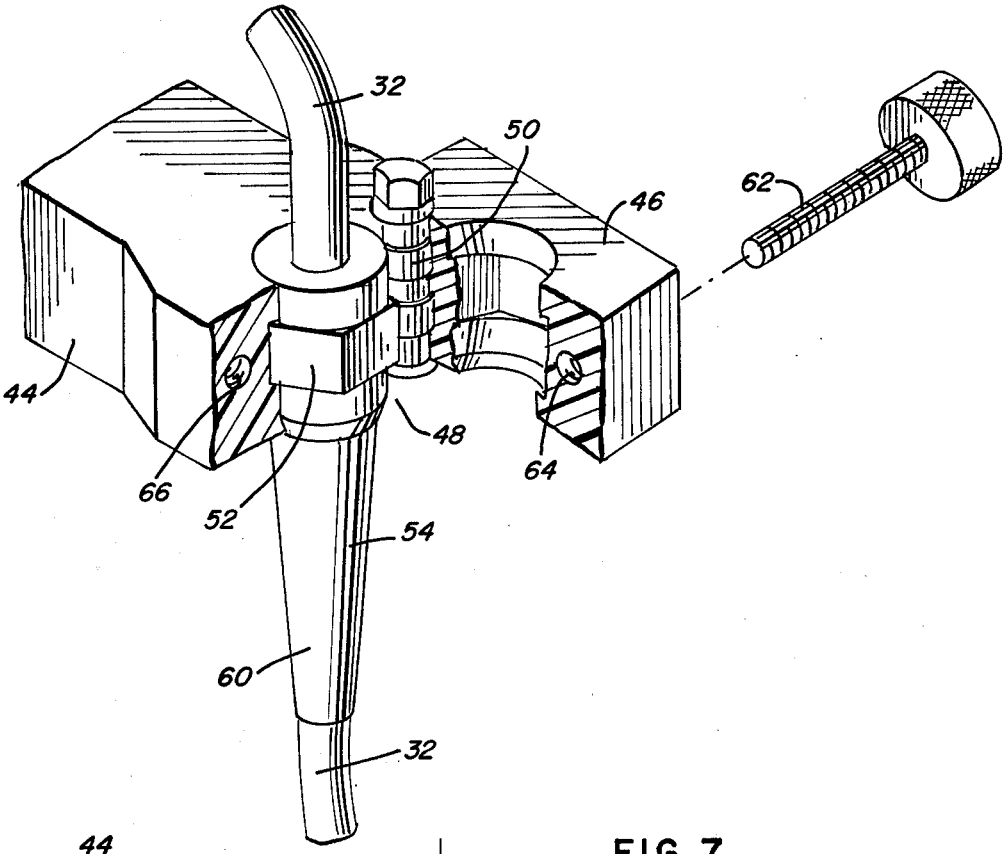
FIG. 5 is a perspective view, with portions broken for clarity, of a flexible sheath and torque arm connector, constructed in accordance with the principles of the present invention.

Referring to the drawings, centrifugal processing apparatus is shown therein adapted for processing glycerolized red blood cells. It is to be understood, however, that the present invention is adaptable to use with various centrifugal processing apparatus, and the specific example given herein is merely for illustrative purposes.

The processing apparatus may include an outer cabinet (not shown) which may be suitably insulated and lined to permit refrigeration of its interior. Access to the interior may be provided by a hinged cover or the like and an external control panel (not shown) enables external control of the operation by an operator.

The red blood cell mass to be processed is subjected to centrifugal force in a processing chamber 10. Processing chamber 10 includes a pair of buckets 12, 13 which are mounted in diametrically opposed positions. Buckets 12, 13 are mounted on a cradle 14 which is rotatable about a central axis *a*. The opposed ends of cradle 14 define slots 15 into which pins 16 carried by buckets 12, 13 may be connected.

The central portion of cradle 14 defines a ring or hub 18, defining a central axial bore 20 for receiving the shaft 22 of an electric motor 24. Shaft 22 is keyed to hub 18 by a set screw 26 or other suitable fastening means.

Hub 18 carries a sheath holder 28, which sheath holder 28 defines a central bore for receiving a sheath 30 which surrounds a portion of umbilical cable segment 32. Holder 28 defines radial openings 34 for permitting tubes 36, which extend from umbilical cable 32, to pass from cable 32 through openings 34 to buckets 12, 13. While holder 28 is fixed to hub 18, as shown most clearly in FIG. 3, the holder 28 may be hinged and opened by loosening screws 38, thereby permitting release of sheath 30, associated cable segment 32 and tubes 36 from the cradle 14. Thus to remove buckets 12 and 13 and their associated tubes 36 from the assembly, pins 16 are removed from slots 15, screws 38 are loosened to allow sheath 30 and associated cable segment 32 to be removed from holder 28 and hub 18, thereby simply releasing the buckets and cable segment from the drive mechanism without requiring passage of tubing or other elements through a central hollow shaft.

A stationary base 40 is provided, comprising a bowl 42 with a stationary or fixed torque arm 44 connected to a side of the bowl 42 and extending to a position whereby the distal end 46 of torque arm 44 defines an opening 48 that is coaxial with axis *a* to receive a fixed end of cable segment 32. Torque arm 44 is hinged at 50 so as to receive the polygonal base 52 of a flexible sheath 54. Flexible sheath 54 defines a central axial bore which receives cable segment 32 snugly therein. Although not essential, in the illustrative embodiment flexible sheath 30 and flexible sheath 54 are identical, with each comprising a polygonal base 56, 52, respectively, a flexible shank portion 58, 60, respectively, and a central axial bore for snugly receiving cable segment 32.

Flexible sheath 54 is clamped to torque arm 44 by means of the hinged assembly with end 46 swinging about hinge 50 and being secured by a manually-graspable bolt 62 which extends through slot 54 and into slot 66 of torque arm 44, thereby grasping base 52 for securement of the flexible sheath to the torque arm. Release of the flexible sheath and its associated cable 32 from the torque arm 44 is readily apparent from FIG. 5.

The bottom portion of base 40 defines an opening 68 for receiving a bearing housing 70. Bearing housing 70 surrounds the lower portion 72 of a one ω turn arm 74, which turn arm 74 is rotatable about axis *a*. Turn arm 74 is coupled to base 40 by a pair of ball bearings 76. A pulley 78 is keyed to lower portion 72 of turn arm 74 and is coupled by belt 80 to the shaft 82 of electric motor 84 which is fixed to base 40. Shaft 82 is set to rotate at one ω so as to cause one ω rotation of turn arm 74 about axis *a*.

Turn arm 74 defines a central bore 86 through which electrical wires 88 extend for connection to electric motor 24. Electrical power is transmitted to electrical lines 88 by means of brushes 90 which are electrically connected to electrical line 94 which is coupled to a suitable source of electric energy. During rotation of turn arm 74 and its lower portion 7, brushes 90 will engage terminals 92 to transmit electrical energy via line 94, brushes 90, terminals 92 and line 88 to electrical motor 24.

In order for motor 24 and motor 84 to be speed synchronized, a pair of additional control leads may be coupled from the motor 24 to terminals 92. Two additional brushes 90 are coupled to a tachometer-feedback circuit for providing appropriate feedback information to motor 24 so as to synchronize motor 24 with motor 84. In this manner, shafts 22 and 82 will both have one $\omega$ synchronized rotation.

Fluid communication with buckets 12 and 13, which rotate as part of processing chamber 10, and with the non-rotating portions of the centrifugal processing system, is provided by the umbilical cable or tubing 32. Cable 32 defines separate passageways or conduits therein, with a cross-sectional configuration of cable 32 being shown in FIG. 4. Although four lumen tubing is preferable, it is to be understood that no limitation with respect to the particular size of the cable or the number of passageways is intended or should be implied. Further, tubing 32 could be circular or polygonal in cross-sectional configuration. Four tubes 36 extend from the four openings defined by four lumen tubing 32, for communication to and from buckets 12 and 13, as discussed above.

Cable 32 is suspended from a point above and axially aligned with processing chamber 10 by means of its fixed connection to torque arm 44 through flexible sheath 54 which acts to relieve the strain. A segment of cable 32 extends downwardly from its axially fixed position, radially outwardly, downwardly and around, and then radially inwardly and upwardly back to the processing chamber 10. The other end of cable 32 is fixed to an axial position by its connection to the holder 28 and it also carries a strain relief sheath 30, similar to strain relief sheath 54.

In the operation of the system, when electric motors 24 and 84 are energized, shafts 22 and 82 will rotate at one $\omega$. The one $\omega$ rotation of shaft 84 will cause turn arm 74 to rotate at one $\omega$ about axis *a*. The one $\omega$ rotation of turn arm 74 about axis *a*, combined with the one $\omega$ rotation of shaft 22 also about axis *a*, will cause two $\omega$ rotation of processing chamber 10. At the same time, cable segment 32 will be rotating at one $\omega$ about axis *a*.

It can be seen that there is no need to pass any portion of the processing chamber 10 or tubing 32 through a hollow central drive shaft. Loading and/or unloading of the system is greatly simplified, in the manner described above.

Although turn arm 74 is shown as a single arm in the illustrative embodiments, in order to enhance the stability of the system it is desirable that appropriate counterbalancing means be used. To this end, turn arm 74 could take the form of three equilateral arms forming a spider-like configuration. Additionally, turn arm 74 could take the form of a half shell or could comprise two opposed arms for balance. It is to be understood that other counterbalancing structural configurations may be employed if desired.

Figure 6:
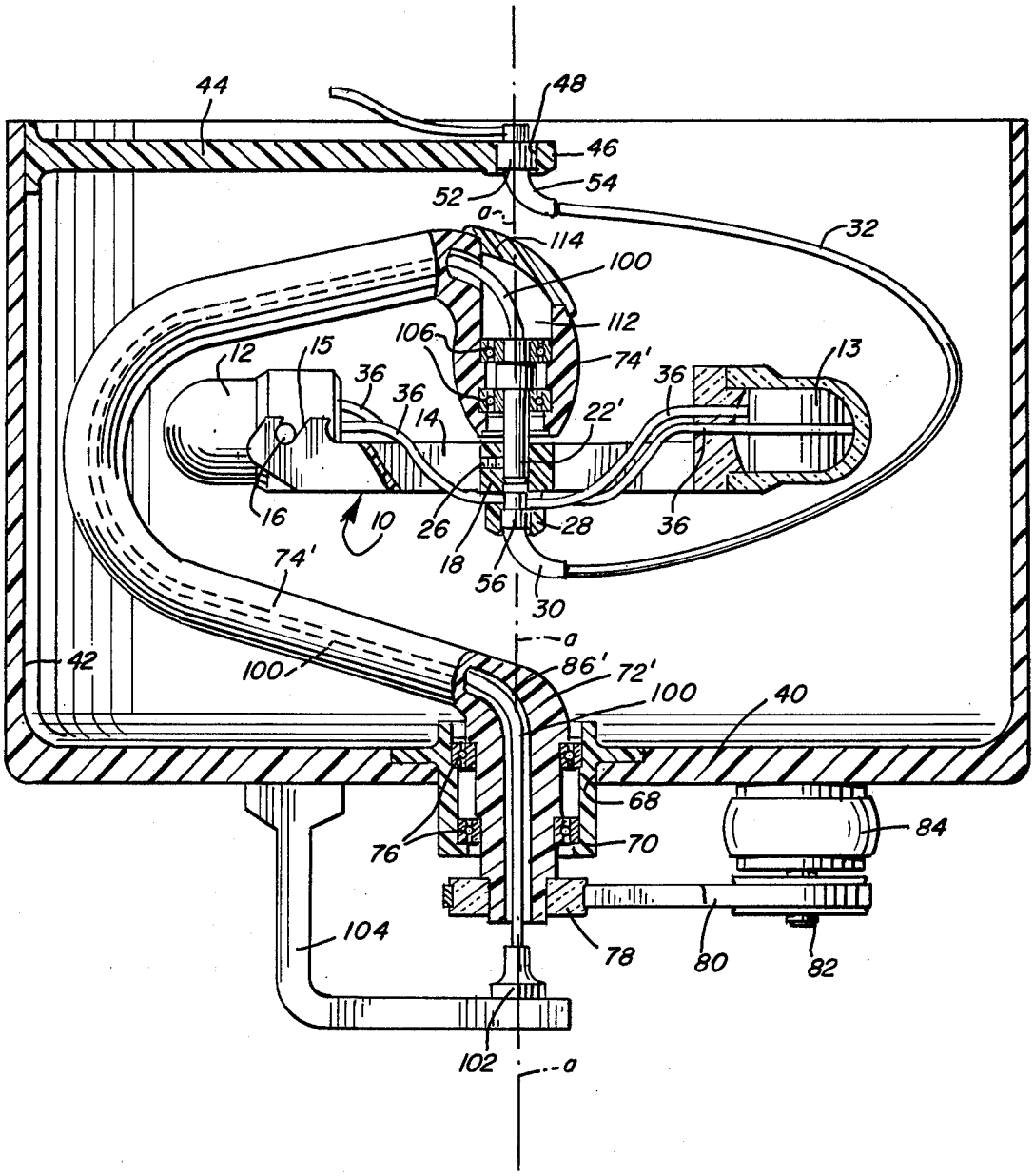
FIG. 6 is an elevational view, taken partially in cross-section for clarity, of centrifugal processing apparatus constructed in accordance with another embodiment of the present invention.

Referring now to FIG. 6, a second embodiment of the invention is shown therein. Identical reference numerals are used in the FIG. 6 embodiment for structure that is similar to the structure of the FIG. 1 embodiment.

In the FIG. 6 embodiment, turn arm 74' has a lower portion 72' which is rotatably coupled to stationary base 40 by means of ball bearings 76. Turn arm 74' defines a central bore 86' through which a flexible shaft 100 extends. A lower portion of flexible shaft 100 extends through lower portion 72' and is fixed at one end 102 thereof to stationary base 40 by means of an appropriate L-shaped bracket 104 fastened to base 40. The other end of flexible shaft 100 is fixed to shaft 22', which is rotatably coupled to turn arm 74' by means of ball bearings 106. Shaft 22' is keyed to hub 18 by means of set screw 26.

Access to an opening 112 defined by turn arm 74' is provided by a cover member 114, which may be removed. Cover member 114 is particularly useful for providing access to flexible shaft 100 in the FIG. 6 embodiment, in order for appropriate connection of flexible shaft 100 and shaft 22' to be made.

In the operation of the FIG. 6 embodiment, only a single electric motor 84 need be utilized. Shaft 82 of motor 84 turns at one $\omega$ to rotate turn arm 74' about axis *a* at one $\omega$. The one $\omega$ rotation of turn arm 74' about axis *a* will cause flexible shaft 100 to rotate about its own axis at one $\omega$, thereby effectively driving shaft 22' at one $\omega$. The combined one $\omega$ rotation of turn arm 74 about axis *a* plus the one $\omega$ rotation of shaft 22 about axis *a* will drive processing chamber 10 about axis *a* at two $\omega$. With processing chamber 10 being driven at two $\omega$, cable segment 32 will rotate about axis *a* at one $\omega$ — the same angular velocity as turn arm 74'.

Figure 7:
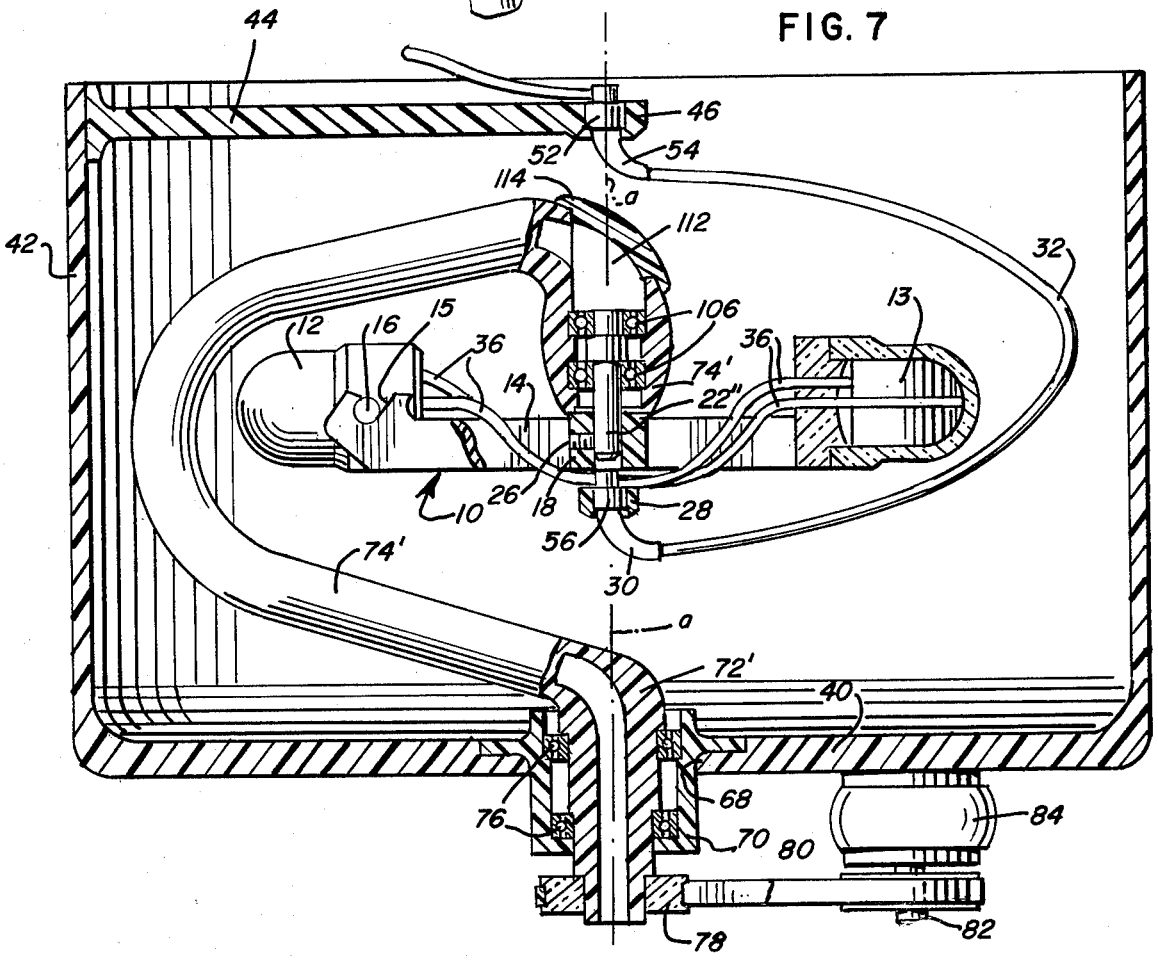
FIG. 7 is an elevational view, taken partially in cross-section for clarity, of centrifugal processing apparatus constructed in accordance with a further embodiment of the present invention.

Referring now to FIG. 7, a third embodiment is shown therein. Identical reference numerals are used with respect to FIG. 7 for structure that is similar to the structure of the FIGS. 1 and 6 embodiments.

In the FIG. 7 embodiment, turn arm 74' is rotatable about axis *a* at one $\omega$ as a result of its being driven by shaft 82 of motor 84, which shaft 82 is rotating at one $\omega$. Turn arm 74' is rotatably coupled to shaft 22'' by means of ball bearings 106. Shaft 22'' is keyed to hub 18 by set screw 26 with holder 28 being carried by hub 18 and rotatable therewith. When motor 84 is energized to drive arm 74' about axis *a*, the turn arm 74' will engage cable segment 32 to drive cable segment 32 about axis *a* at one $\omega$.

As a result of one end of cable segment 32 being fixed to torque arm 44 along axis *a* and the other end of cable segment 32 being fixed to processing chamber 10 along axis *a*, the cable segment 32 will impart two $\omega$ rotation to processing chamber 10. It is preferred that cable segment 32 have sufficient rigidity to provide the driving torque required for rotating processing chamber 10 about axis *a*. As a specific example, although no limitation is intended, cable 32 may be formed of DuPont HYTREL ® polyester elastomer.

It can be seen that centrifugal processing apparatus has been provided in which loading or unloading of the system is permitted without requiring an operator to pass tubing or other portions of the system through a hollow central shaft. Further, loading and unloading is permitted without breaking connections in tubing or other parts. Although three illustrative embodiments of the invention have been shown and described, it is to be understood that various modifications and substitutions may be made by those skilled in the art without departing from the novel spirit and scope of the present invention.

What is claimed is:

1. Centrifugal processing apparatus, which comprises:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, said cable segment extending around said processing chamber with the other end of the cable segment being attached substantially on said axis in rotationally locked engagement to the processing chamber;

a one ω turn arm coupled to one side of the processing chamber, around the processing chamber and to a spaced location at the other side of the processing chamber;

first rotatable support means coupling said one ω turn arm to said processing chamber at said one side thereof;

second rotatable support means coupling said one ω turn arm to said stationary base at the other side of the processing chamber; and means for rotating said turn arm at one ω about said predetermined axis.

2. Centrifugal processing apparatus as described in claim 1, said rotating means comprising an electric motor.

3. Centrifugal processing apparatus as described in claim 1, said first rotatable support means comprising a plurality of bearings.

4. Centrifugal processing apparatus as described in claim 1, said second rotatable support means comprising a plurality of bearings.

5. Centrifugal processing apparatus as described in claim 2, including an electric motor fixed to said one ω turn arm at said one side of said processing chamber, said motor including a shaft extending therefrom and being fixed to said processing chamber, said first rotatable support means comprising means coupling said shaft to a portion of said electric motor that is fixed to said one ω turn arm.

6. Centrifugal processing apparatus as described in claim 5, in which said one ω turn arm carries an electrical line for energizing said electric motor fixed to said one ω turn arm.

7. Centrifugal processing apparatus as described in claim 5, wherein the shafts of both electric motors rotate at one ω, whereby the combined rotation of said one ω turn arm and said one ω rotation of the shaft fixed to said processing chamber results in two ω rotation of said processing chamber.

8. Centrifugal processing apparatus as described in claim 1, including a flexible shaft carried by said one ω turn arm, said flexible shaft being fixed at one point to said stationary base substantially on said predetermined axis and being fixed at another point to said processing chamber substantially on said predetermined axis.

9. Centrifugal processing apparatus as described in claim 1, wherein said rotating means comprises an electric motor for rotating said turn arm at one ω; and further including a flexible shaft carried by said one ω turn arm, said flexible shaft being fixed at one point to said stationary base substantially on said predetermined axis and said flexible shaft being fixed at another point to said processing chamber substantially on said predetermined axis, said one ω rotation of said turn arm cooperating with the one ω rotation of the flexible shaft about its own axis to cause two ω rotation of said processing chamber.

10. Centrifugal processing apparatus as described in claim 8, in which said one ω turn arm defines an internal bore for receiving said flexible shaft, and means for providing access to said flexible shaft from the outside of said turn arm.

11. Centrifugal processing apparatus, which comprises:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, said cable segment extending around said processing chamber with the other end of the cable segment being attached substantially on said axis in rotationally locked engagement to the processing chamber;

a one ω turn arm coupled to one side of the processing chamber, around the processing chamber and to a spaced location at the other side of the processing chamber;

an electric motor fixed to said one ω turn arm at said one side of the processing chamber, said electric motor including a shaft fixed to said processing chamber and rotatable at one ω;

rotatable support means coupling said one ω turn arm to said stationary base at the other side of the processing chamber; and an electric motor connected to said one ω turn arm for rotating said turn arm at one ω, said one ω rotation of said turn arm cooperating with said one ω rotation of said shaft fixed to said processing chamber whereby said processing chamber rotates at two ω.

12. Centrifugal processing apparatus as described in claim 11, said one ω turn arm defining a bore carrying an electrical line coupled to said electric motor which is fixed to said one ω turn arm.

13. Centrifugal processing apparatus as described in claim 11, said rotatable support means comprising a plurality of bearings.

14. Centrifugal processing apparatus, which comprises:

a stationary base;

a processing chamber rotatably mounted with respect to said base for rotation about a predetermined axis;

a flexible umbilical cable segment for establishing communication with said processing chamber, one end of said cable segment being fixed with respect to said base substantially along said axis at one side of the processing chamber, said cable segment extending around said processing chamber with the other end of the cable segment being attached substantially on said axis in rotationally locked engagement to the processing chamber;

a one ω turn arm coupled to one side of the processing chamber, around the processing chamber and to a spaced location at the other side of the processing chamber;

rotatable support means coupling said one ω turn arm to said processing chamber at said one side thereof;

rotatable support means coupling said one ω turn arm to said stationary base at the other side of the processing chamber;

an electric motor for rotating said turn arm at one ω about said predetermined axis;

a flexible shaft carried by said one ω turn arm, said flexible shaft being fixed at one point to said stationary base substantially on said predetermined axis and fixed at another point to said processing chamber substantially on said predetermined axis, said one ω rotation of said turn arm about said predetermined axis combined with the one ω rotation of said flexible shaft about its own axis being operative to rotate said processing chamber about said predetermined axis at two ω.

15. Centrifugal processing apparatus as described in claim 14, said one ω turn arm defining an internal bore for receiving said flexible shaft therein; and means for permitting access to said flexible shaft from the outside of said one ω turn arm.

16. Centrifugal processing apparatus as described in claim 14, said rotatable support means comprising a plurality of bearings.

17. Centrifugal processing apparatus, which comprises:

a stationary base;

a processing chamber rotatably mounted with respect to said base for rotation about a predetermined axis at an angular velocity of two ω with respect to said stationary base;

a flexible umbilical cable segment for establishing communication with said processing chamber, one end of said cable segment being fixed with respect to said base substantially along said axis at one side of the processing chamber, the other end of the cable segment being attached substantially on said axis in rotationally locked engagement to the other side of the processing chamber;

a first one ω drive means rigidly fastened to said processing chamber for rotating said processing chamber about said predetermined axis;

a second one ω drive means;

means connecting said first one ω drive means to said second one ω drive means;

said second one ω drive means being operative to rotate said connecting means about said axis at an angular velocity of one ω with respect to said stationary base;

said connecting means and said first one ω drive means being operative to cooperatively rotate said processing chamber about said axis at an angular velocity of two ω with respect to said stationary base; and said first and second one ω drive means being located on opposite sides of said processing chamber, with said first drive means being located intermediate said one end of said cable segment and said processing chamber.

18. Centrifugal processing apparatus as described in claim 17, said first and second one ω drive means comprising electric motors and said connecting means comprising a turn arm carrying electrical power lines for energizing said first drive means.

19. Centrifugal processing apparatus as described in claim 18, said connecting means comprising a turn arm having a configuration that allows the turn arm and said processing chamber to rotate about said axis at different speeds without colliding, said turn arm rotating about said axis at one-half the angular velocity of said processing chamber rotation.

* * * * *